United States Patent [19]

Felling

[11] Patent Number: 5,069,504

[45] **Date of Patent: * Dec. 3, 1991**

[54] CHAISE LOUNGE WITH MOTOR-DRIVEN ADJUSTABLE CANOPY

[76] Inventor: Gerald J. Felling, 230 Arroyo Rd., Langunitas, Calif. 94938

[ * ] Notice: The portion of the term of this patent subsequent to May 14, 2008 has been disclaimed.

[21] Appl. No.: 628,486

[22] Filed: Dec. 14, 1990

Related U.S. Application Data

[63] Continuation-in-part of Ser. No. 496,520, Mar. 20, 1990, Pat. No. 5,015,032, which is a continuation-in-part of Ser. No. 482,190, Feb. 20, 1990, which is a continuation-in-part of Ser. No. 385,057, Jul. 26, 1989, abandoned.

[51] Int. Cl.[5] ..... A47C 7/62

[52] U.S. Cl. ..... 297/184; 297/325

[58] Field of Search ..... 297/184, 306; 135/96

[56] References Cited

U.S. PATENT DOCUMENTS 2,243,984 6/1941 Singewald ..... 297/184 X 4,790,598 12/1988 Locher ..... 297/325

FOREIGN PATENT DOCUMENTS 434019 7/1925 Fed. Rep. of Germany ..... 297/184

489094 12/1929 Fed. Rep. of Germany ..... 297/184

583596 1/1925 France ..... 297/184

293675 10/1953 Switzerland ..... 297/184

*Primary Examiner*—Laurie K. Cranmer

*Attorney, Agent, or Firm*—Phillips, Moore, Lempio & Finley

[57] ABSTRACT

A chaise lounge, usable for sunbathing and other recreational purposes, comprises a stationary base having a normally upright hood-like canopy pivotally mounted rearwardly thereon. The canopy is adapted to be pivoted between a normal upright position to form a seating arrangement and a lowered position placing a back of the canopy in alignment with a top of the base. A combined moving, holding and locking control system includes an electric motor and an actuating mechanism for releasably holding and locking the canopy in a selected position between its upright and lowered positions in response to selective activation of the motor.

15 Claims, 3 Drawing Sheets

CHAISE LOUNGE WITH MOTOR-DRIVEN ADJUSTABLE CANOPY

CROSS-REFERENCE TO RELATED APPLICATIONS

This application is a continuation-in-part of U.S. patent application Ser. No. 07/496,520, filed on Mar. 20, 1990, for "Chaise Lounge With Adjustable Canopy," now U.S. Pat. No. 5,015,032, which is a continuation-in-part of pending U.S. patent application Ser. No. 07/482,190, filed on Feb. 20, 1990, for "Sheltered Lounge Chair," which is a continuation-in-part of U.S. patent application Ser. No. 07/385,057, filed on July 26, 1989, now abandoned.

TECHNICAL FIELD

This invention relates generally to a recreational and vacational seating and lounging arrangement and more particularly to a chaise lounge having an adjustable canopy adapted to be locked in one of an infinite number of positions between its upright and lowered positions in response to selective activation of an electric motor.

BACKGROUND OF THE INVENTION

Chaise lounges, having canopies mounted thereon, have found widespread recreational and vacational use, particularly at beaches and on the sun decks and patios of homes and hotels. However, the backrest for this type of lounge, popular in Europe, is often-times fixed in position. Thus, the user is unable to adjust the backrest for his or her comfort. The lounge was later modified to permit the backrest to pivot on the lounge. However, the externally operated mechanical locking systems utilized are difficult to manipulate and the substantial weight of the backrest (e.g., 75 lbs.) renders the lounge impracticable for every day use.

U.S. Pat. Nos. 2,243,984; 2,279,748 and 2,837,140 discloses various types of beach chairs wherein an adjustable backrest or canopy is pivotally mounted on a frame to adjust the inclination of the backrest from an upright position to a lowered position. Chairs of this type normally rely on legs or struts, positioned rearwardly of the pivot point whereat the backrest pivots on the frame, for supporting the weight of the person sitting or lying thereon.

SUMMARY OF THE INVENTION

An object to this invention is to provide an improved and easily adjusted chaise lounge useful for a wide variety of recreational and vacational purposes. The lounge includes a motor-actuated canopy for optionally providing full sun bathing or sun and wind protection, at the convenience of the user.

The chaise lounge of this invention comprises a stationary base frame having laterally spaced and vertically disposed sides and a horizontally disposed top adapted to retain a seating cushion thereon. A normally upright canopy frame comprises laterally spaced and vertically disposed sides, a top and a normally upright back, all secured together to form a hood or cowl. The canopy frame is pivoted rearwardly on the base frame to permit the canopy frame to be moved through an infinite number of positions between its normal upright position and its lowered position, placing the back of the canopy frame in at least general horizontal alignment with the top of the base frame. A combined moving, holding and locking means is adapted to release and move the canopy to a selected position and to hold and lock the canopy frame in such position, between its upright and lowered positions. Such means includes a reversible electric motor secured on the base frame and actuating means connected to the motor and pivotally interconnected between the base frame and canopy frame for moving the canopy frame to its selected position in response to activation of the motor.

BRIEF DESCRIPTION OF THE DRAWINGS

Other objects and advantages of this invention will become apparent from the following description and accompanying drawings wherein.

DESCRIPTION OF THE PREFERRED EMBODIMENTS

GENERAL DESCRIPTION

Figure 1:
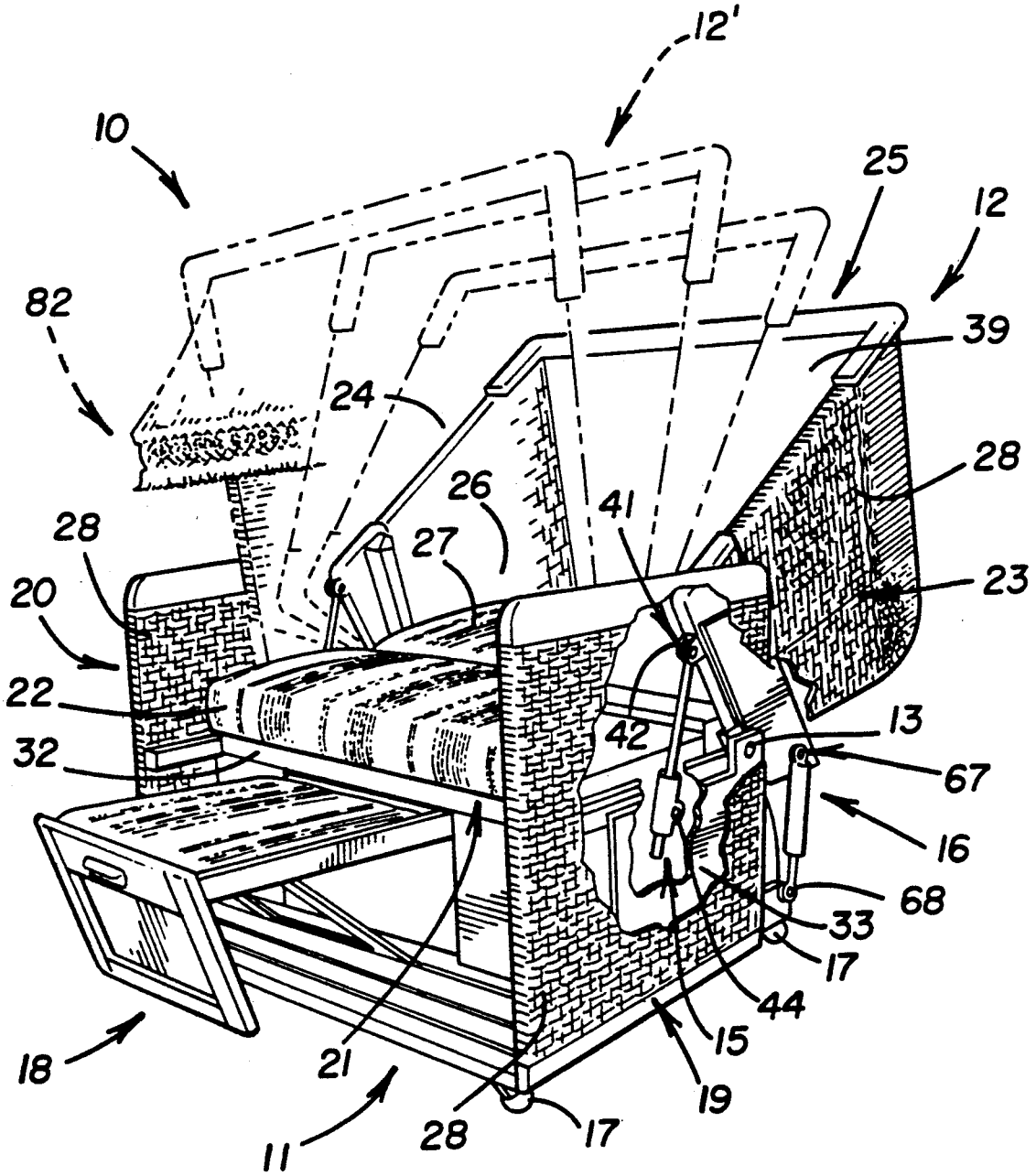
FIG. 1 is a partially sectioned frontal perspective view of a chaise lounge of the type disclosed in U.S. patent application Ser. No. 07/496,520 with a canopy thereof shown in its fully lowered position and further showing various raised positions of the canopy in phantom lines.

Referring to FIG. 1, a chaise lounge 10, described in my above-referenced U.S. patent application Ser. No. 07/496,520, comprises a base 11 having a canopy 12 pivotally mounted rearwardly thereon by laterally spaced and aligned pivot pins 13 (one shown). The canopy is adapted to be selectively pivoted from a normal upright position, forming a seating arrangement, to its illustrated full line lowered position, forming a bed-like or "sunning" arrangement. A hand-controlled cable system is adapted to release a pair of laterally spaced combined holding and locking struts 15, pivotally interconnected between base 11 and canopy 12, to selectively hold and lock the canopy in any one of an infinite number of positions, as shown by phantom lines 12', between its normal upright and lowered positions.

The upper end of strut 15 is pivotally connected to the frame of canopy 12 by a ball and socket connection 41 at a bracket 42. The strut is pivotally connected to a steel plate 33, formed integrally with the frame of base 11, by a ball and socket connection 44. A pair laterally spaced combined cushioning and return struts or cylinders 16 are pivotally interconnected between base 11 and canopy 12 at 68,67 to cushion movement of the canopy when it is moved from its upright position towards its lower position.

Cylinders 16 further function to automatically move and return the canopy to its upright position in response to release of locking struts 15. Each corner of base 11 can be mounted on a standard caster 17 to facilitate movement of the lounge into various orientations for sun bathing, viewing or similar recreational delights. A standard collapsible and storable leg and foot rest 18 can be suitably mounted on the frontal side of base 11 for convenience of the user.

Base 11 comprises laterally spaced and vertically disposed opposite side panels 19 and 20 and a horizontally disposed top or seat panel 21, adapted to retain a seating cushion 22 and sub-cushion 32 thereon. The canopy comprises laterally spaced and vertically disposed sides 23 and 24, a top 25 and a normally upright back 26, adapted to have a back cushion 27 mounted thereon. Thus, when canopy 12 is moved to its fully lowered position illustrated in FIG. 1, back 26 of the canopy and top 21 of the base, as well as cushions 22 and 27, are placed in at least general horizontal alignment, relative to each other, to form the bed-like or "sunning" arrangement for the user.

The sides, top and back of the canopy are preferably covered with a woven, flexible material 28 to provide air ventilation through the canopy for convenience of the user. A porous liner 39 can be secured within canopy 12 and a sun shade 82 can be suitably mounted forwardly thereon. Woven material 28, underlying back cushion 27, is suspended from a frame of the canopy to provide the canopy with a high degree of structural integrity and the desired amount of flexibility.

As further described, base 11 comprises a base frame composed of a plurality of wooden or metallic frame members suitably secured together to form a box-like rigid construction having an open front side. Canopy 12 is also described as being formed by a plurality of structurally integrated wooden or metallic frame members that form the rigid skeleton frame for contiguous sides 23 and 24, top 25 and back 26 of the canopy.

A cable system is also described and comprises an operator-controlled reciprocal handle (or slide button), adapted to selectively release struts 15 simultaneously. The handle or button is suitably mounted within canopy 12 for ease of use. The standard cables are guided by brackets secured on the base frame and the canopy frame to ensure that a pulling of the cables will function to unlock struts 15.

Figure 2:
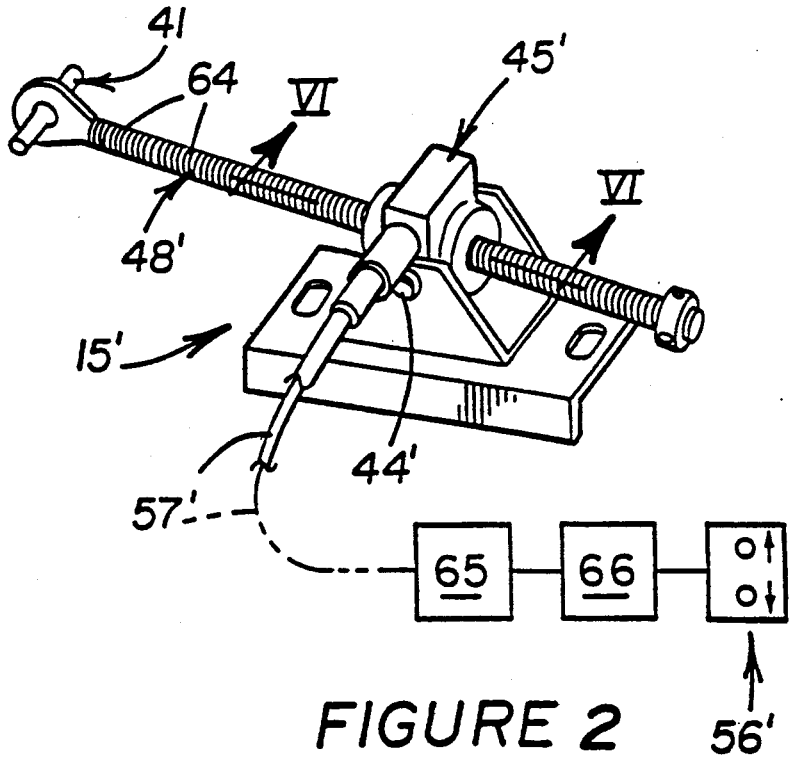
FIG. 2 illustrates a combined moving, holding and locking control system for moving the canopy to a selected position.
Figure 3:
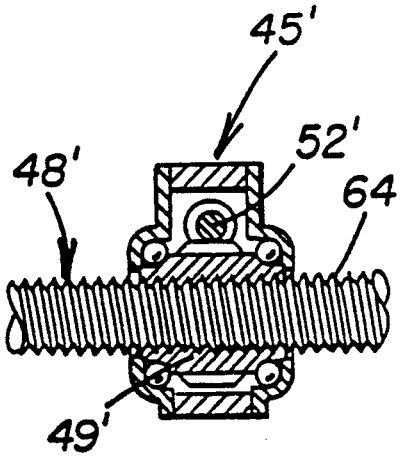
FIG. 3 is a sectional view, generally taken in a direction of arrows VI—VI in FIG. 2.

FIGS. 2 and 3 illustrate an alternative combined releasable moving, holding and locking control system 15', also described in the above-referenced application to replace struts 15 and strut 16 can be eliminated. The combined control system comprises a threaded rod 48' adapted for axial movement in a housing 45', under control of an operator switch 56' adapted to be mounted in canopy 12. As shown in FIG. 2, rod 48' comprises spiral teeth 64 adapted to be suitably engaged by meshing teeth of a gear 49'.

Gear 49' is rotatably mounted by axially spaced annular bearings in housing 45' and has external teeth meshed with external teeth of a gear 52'. Gear 52' is secured to the distal end of a cable 57'. Thus, rotation of the gear in FIG. 6 will rotate gear 49' and move rod 48' axially in opposite directions, depending on the direction of rotation of gear 52'.

One end of rod 48' has an eyelet adapted to be pivotally mounted on pin 41 (or ball and socket) to pivot the canopy of base 11 in the manner described in the application. A pivot connection (pin or ball and socket) 44' pivotally mounts housing 45' on a bracket adapted for securance to steele plate 33 (FIG. 1) to place the pivot axes of pins 41 and 44' in parallel relationship and positioned similar to pins 41 and 44. Operator-control switch 56' has a pair of buttons thereon to selectively activate a reversible electrical motor 65 to, in turn, rotate flexible cable 57' (similar to the speedometer cable of an automobile) and gear 52' in its selected direction.

A standard rechargeable battery pack 66 can be mounted in base frame 30, along with motor 65', to provide the power source for the motor. Control system 15' is preferred for those chaise lounge applications wherein it proves desirable to fully automate the lounge "at the touch of a button." In particular, the canopy can be moved and locked at a selected position by simply operating control switch 56' whereas the aforedescribed control system relies on manual power to move the canopy down from its upright position.

DETAILED DESCRIPTION

Figure 4:
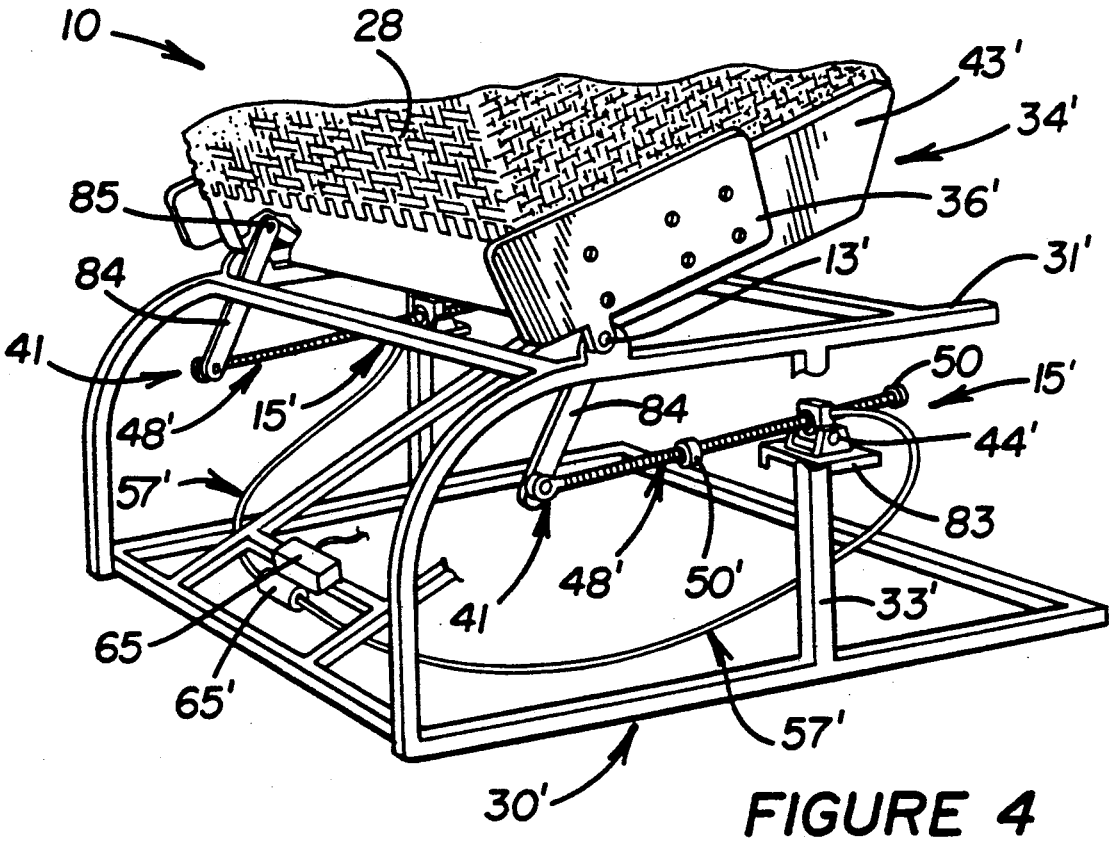
FIG. 4 partially illustrates a chaise lounge utilizing the control system therein.

This invention is drawn to the utilization of the type of combined moving, holding and locking control system 15' in the similar type of chaise lounge 10', shown in FIGS. 3 and 4. Numerals shown in FIGS. 4–6 that are identical to those used for describing the various components in U.S. patent application Ser. No. 07/496,520 (incorporated by reference herein), depict components having corresponding construction and/or functions. As described hereinafter, combined moving, holding and locking control system 15' also essentially includes electric motor 65 and actuating means, including rod 48' and its attendant drive components connected to the motor and pivotally interconnected between the base frame and canopy frame for selectively pivoting the canopy frame on the base frame in response to activation of the motor by switch 56' (FIG. 2).

As shown in FIG. 4, a base frame 30' comprises a plurality of metallic structural members, such as aluminum or steel tubing, suitably secured together by welding or the like. A canopy frame 34' comprises a reinforcement rail 43' on each lateral side thereof and a steel plate member 36' is suitably secured on the outside of each reinforcement rail. Each plate member 36' is pivotally mounted on a horizontally disposed upper frame member 31' of base frame 30' whereby the canopy frame can be pivoted on the base frame in the manner described above.

Threaded rod 48' and its actuating mechanism (FIGS. 2 and 3) are pivotally mounted at 44 on a bracket 83 suitably welded or otherwise secured to the inner side of a vertically disposed base frame structural member 33'. The distal end of the rod is pivotally mounted at a ball and socket connection 41 to the lower end of a lever 84. The upper end of the lever is suitably secured within a slot formed beneath the rearward end of reinforcement rail 43' by standard epoxy and/or a bolt 85. Although the upper end of the lever is preferably secured to rail 43' at a position forwardly of pivot pin 13', it could be secured to the rail at a position rearwardly of the pivot pin.

Thus, extension or retraction of rod 48' will function to move the lever in an arch to simultaneously pivot structurally attached canopy frame 34' about the pivot axes of laterally spaced pivot pins or bolts 13'. The above-described drive mechanism for each rod 48' is controlled by a respective rotary drive cable 57', further connected to a standard split-drive power take-off 65'. The standard power take-off may comprise, for example, a pinon gear secured to the output shaft of motor 65 to mesh with a pair of opposed face gears, such as of the Spiroid type of gears manufactured by the Spiroid Division of Illinois Tool Works of Chicago, Ill.

Thus, selective actuation of reversible motor 65, under control of button switch 56' (FIG. 2), will energize the motor via battery 66 to simultaneously extend or retract rods 48' the desired amount. When the button is released after the canopy has been pivoted to its selected position on the base, the actuating means (gears, cable, etc.) for the rod will simultaneously and automatically hold and lock the canopy in such position relative to the base. Sufficient clearances and relative movement is provided by ball and socket connections 41 and 44' to facilitate pivoting of the canopy between its upright and fully lowered positions. Each rod 48' is suitably designed to extend and retract the proper amount to accomplish the same. Maximum extension of the rod in one direction to place the canopy in its fully upright position is controlled by a stop collar 50 whereas maximum extension of the rod in the opposite direction to place the canopy in its fully lowered position (FIG. 1) is controlled by a stop collar 50'. The stop collars can be swaged or otherwise suitably secured to the rod once the proper extents of travel of the rod have been determined.

Although FIG. 4 shows each generally horizontally disposed rod 48' positioned adjacent to the upper end of the vertical base frame member 33', it should be understood that this positioning and location could be changed. For example, each mounting bracket 83 could be secured to the lower end of a respective member 33' to position each rod 48' and to its attendant drive mechanism adjacent to ground level. Lever 84 would be suitably lengthened to accommodate such positioning and to substantially lengthen its effective moment arm, i.e., increase the "mechanical advantage" of the control system whereby relatively less power would be required to pivot the canopy.

Figure 5:
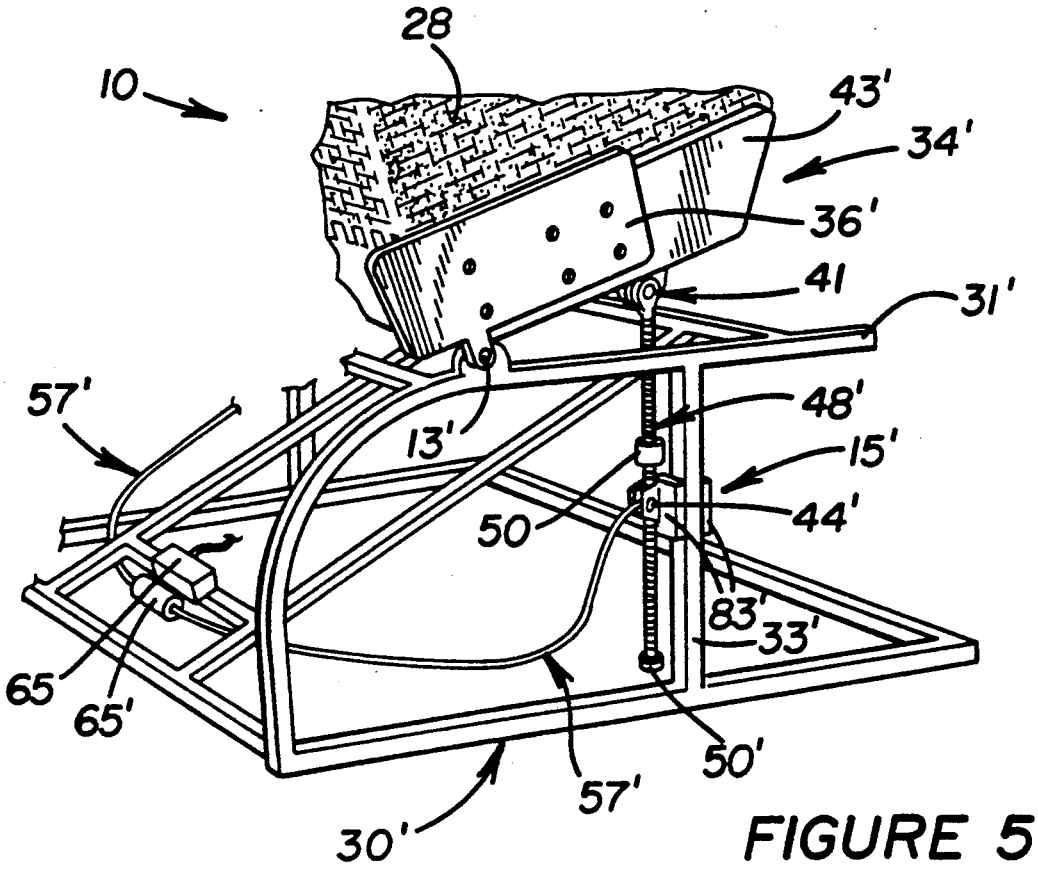
FIG. 5 partially illustrates a repositioning of the control system in the chaise lounge of FIG. 4.

FIG. 5 illustrates a general vertical disposition of each rod 48' in contrast to the general horizontal disposition of the rods, shown in FIG. 4. A bracket 83' is welded or otherwise suitably secured on vertically disposed base frame member 33' to mount the actuating mechanism (FIG. 2) for the rod thereon. The vertical disposition of the bracket is such so as to permit the rod to extend and retract a sufficient amount to enable the canopy to be pivoted between its upright and fully lowered position on the base as dictated by stop collars 50,50'.

Figure 6:
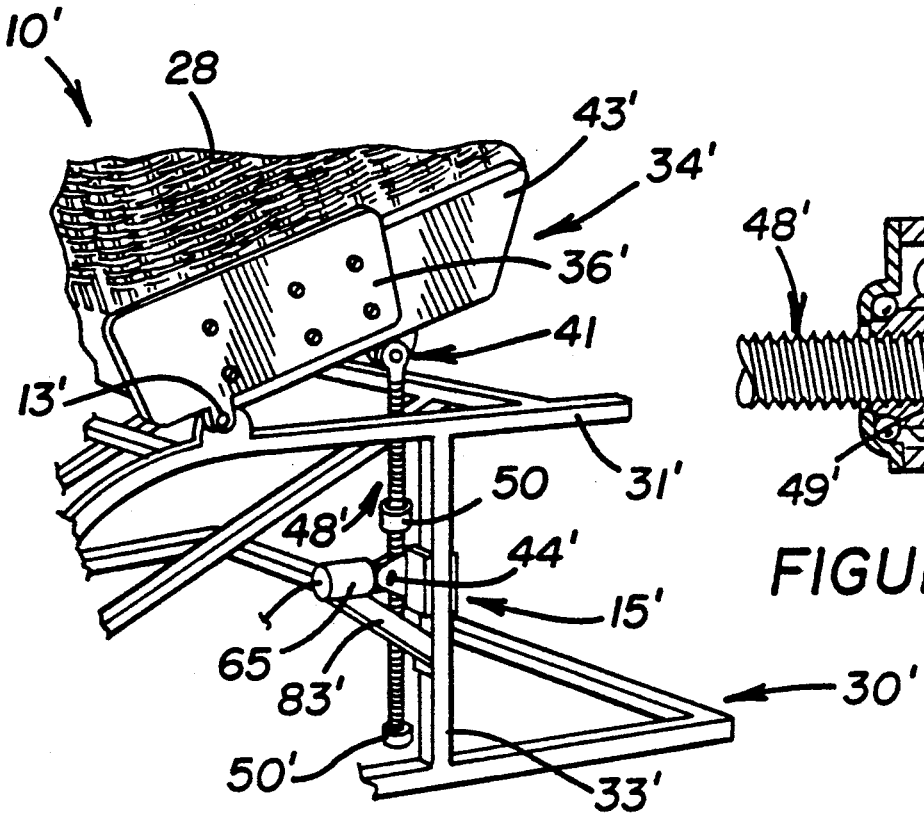
FIG. 6 illustrates a modification of the control system for the chaise lounge of FIG. 4.

FIG. 6 illustrates a modification wherein each rod 48' is mounted on the base frame in a vertically disposed manner, similar to that shown in FIG. 5. However, a separate motor 65 is provided for directly driving gear 52' (FIG. 3) of the actuating mechanism for the rod, i.e., cable 57' and power take-off 65' are eliminated from this system. Although it is preferable to have an actuating mechanism connected to each side of the lounge, it should be understood that in certain application it may prove desirable to only utilize a single combined moving, holding and locking system on one side thereof.

I claim:

1. A sheltering lounge chair usable for sun bathing and the like comprising a base frame having laterally spaced and vertically disposed sides and a horizontally disposed top adapted to retain a seating cushion thereon, a normally upright canopy frame having laterally spaced and vertically disposed sides, a top and a normally upright back all secured together to form a hood open on its frontal side, pivot means for pivotally mounting a rearward end of said base frame for permitting said canopy frame to be moved through an infinite number of positions between its normal upright position to form a seating arrangement and a fully lowered position placing the back of said canopy frame in at least general horizontal alignment with the top of said base frame to form a bed, and combined moving, holding and locking means for selectively releasing and moving said canopy to a selected position and for holding and locking said canopy frame in said selected position between its upright and fully lowered positions, including a reversible electric motor secured on said base frame and actuating means connected to said motor and pivotally interconnected between said base frame and said canopy frame for selectively pivoting said canopy frame on said base frame in response to activation of said motor.

2. The sheltering lounge chair of claim 1 further comprising operator-control means adapted to be mounted within said canopy frame for ready access to a person therein for selectively activating said combined moving, holding and locking means.

3. The sheltering lounge chair of claim 1 wherein a said actuating means is positioned on each lateral side of said lounge chair.

4. The sheltering lounge chair of claim 3 wherein a common said motor is connected to each said actuating means.

5. The sheltering lounge chair of claim 3 wherein a separate said motor is connected to each said actuating means and is mounted closely adjacent thereto on said base frame.

6. The sheltering lounge chair of claim 1 or 3 wherein the opposite sides of said canopy frame comprise a pair of at least generally parallel reinforcement rails and wherein said actuating means is pivotally connected to a respective one of said reinforcement rails.

7. The sheltering lounge chair of claim 4 wherein said actuating means comprises a lever integrally secured to a respective one of said reinforcement rails to extend therebelow.

8. The sheltering lounge chair of claim 1 or 3 wherein the opposite sides of said base frame comprise a pair of at least generally parallel upper frame members and wherein said pivot means pivotally mounts said canopy frame on each of said frame members.

9. The sheltering lounge chair of claim 1 wherein said actuating means comprises a housing pivotally mounted on a respective side of said base frame and a threaded rod movably mounted in said housing and having an end thereof pivotally connected to a respective side of said canopy frame.

10. The sheltering lounge chair of claim 9 wherein the opposite sides of said base frame comprise a pair of vertical disposed structural members and wherein said housing is pivotally mounted on a respective one of said structural members.

11. The sheltering lounge chair of claim 9 further comprising stop means on said rod, positioned at a preset distance from each other and disposed on opposite sides of said housing, for engaging said housing when said canopy is moved to its upright or fully lowered position.

12. The sheltering lounge chair of claim 9 wherein said actuating means further comprises a gear rotatably mounted in said housing and threadably engaged with said rod.

13. The sheltering lounge chair of claim 12 wherein said actuating means further comprises cable means for rotating said gear and switch means for selectively energizing said motor to rotate said cable means and said gear in either direction to raise or lower said canopy frame on said base frame.

14. The sheltering lounge chair of claim 9 wherein said rod is normally at least generally horizontally disposed adjacent to a respective inner side of said base frame when said canopy frame is in its upright position on said base frame.

15. The sheltering lounge chair of claim 9 wherein said rod is normally at least generally vertically disposed adjacent to a respective inner side of said base frame when said canopy frame is in its upright position on said base frame.

* * * * *